US006452078B1

(12) United States Patent
Harris

(10) Patent No.: US 6,452,078 B1
(45) Date of Patent: Sep. 17, 2002

(54) REED MAINTAINER FOR WOODWIND INSTRUMENTS

(76) Inventor: Larry Harris, 9926 Beach Blvd. #7114, Jacksonville, FL (US) 32246

( * ) Notice: Subject to any disclaimer, the term of this patent is extended or adjusted under 35 U.S.C. 154(b) by 28 days.

(21) Appl. No.: 09/693,628

(22) Filed: Oct. 20, 2000

(51) Int. Cl.[7] ..... G10D 9/02
(52) U.S. Cl. ..... 84/383 R; 84/383 A
(58) Field of Search ..... 84/383 R, 383 A, 84/387 A, 453, 330

(56) References Cited

U.S. PATENT DOCUMENTS

| | | | | |
|---|---|---|---|---|
| 1,016,055 A | | 1/1912 | Winquist | |
| 1,410,066 A | | 3/1922 | Knopf | |
| 1,495,322 A | | 5/1924 | Greene et al. | |
| 2,502,558 A | | 4/1950 | Costello | |
| 4,296,668 A | | 10/1981 | Lorensini | |
| D277,967 S | | 3/1985 | Gholston, Jr. | |
| 5,929,353 A | * | 7/1999 | Tannibaum | 84/380 R |
| 6,150,593 A | * | 11/2000 | Holden | 84/383 R |
| 6,284,960 B1 | * | 9/2001 | DaSilva et al. | 84/458 |

* cited by examiner

*Primary Examiner*—Robert E. Nappi
*Assistant Examiner*—Kim Lockett

(57) ABSTRACT

A reed maintainer for woodwind instruments for extending the life span of the reed in woodwind instruments. The reed maintainer for woodwind instruments includes a tubular member having a first end and a second end and having a bore extending therethrough; and also includes slat members being attached to the tubular member and extending outwardly therefrom; and further includes an annular flange member being securely attached to the tubular member.

9 Claims, 2 Drawing Sheets

FIG. 3
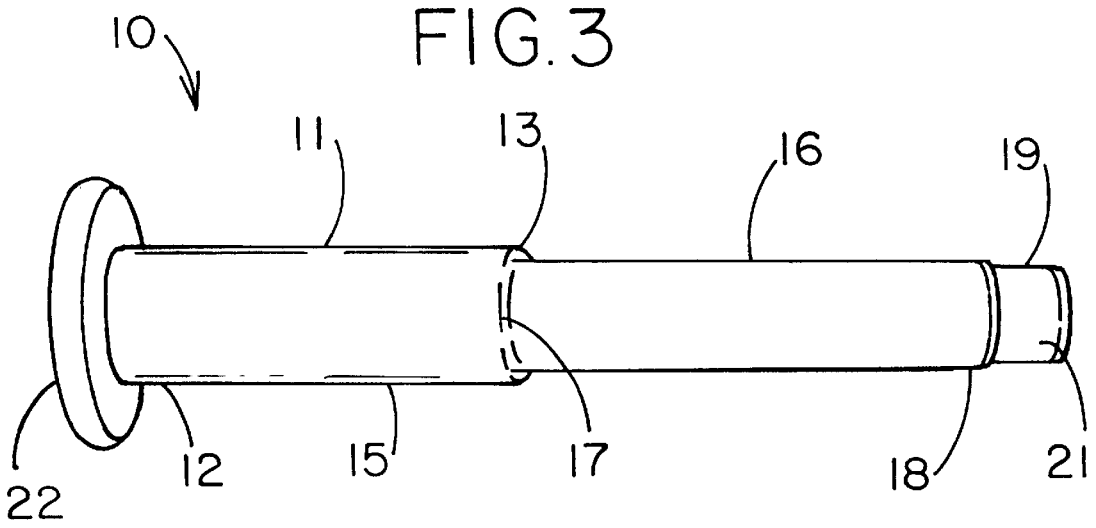
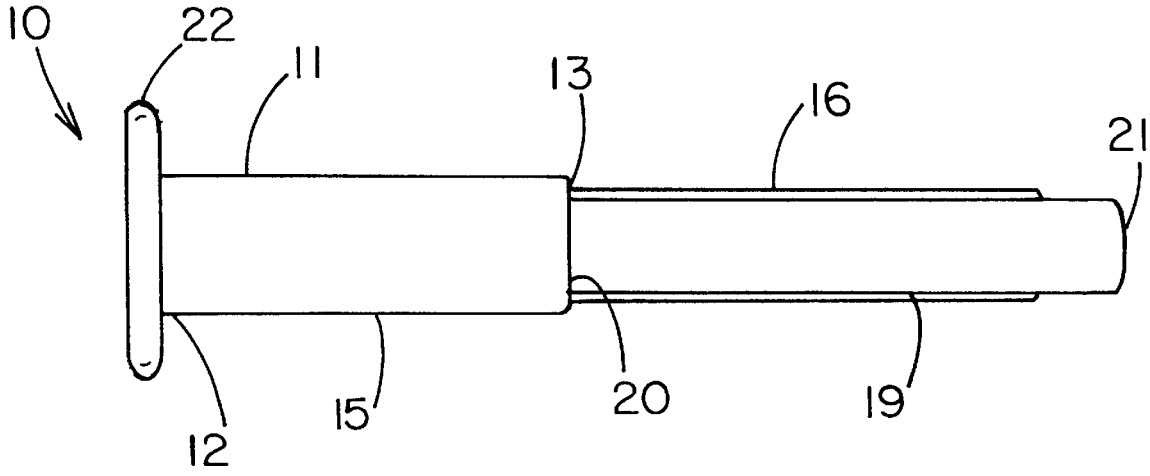
FIG. 4

REED MAINTAINER FOR WOODWIND INSTRUMENTS

BACKGROUND OF THE INVENTION

1. Field of the Invention

The present invention relates to a reed maintaining device and more particularly pertains to a new reed maintainer for woodwind instruments for extending the life span of the reed in woodwind instruments.

2. Description of the Prior Art

The use of a reed maintaining device is known in the prior art. More specifically, a reed maintaining device heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,296,668; U.S. Pat. No. 2,502,558; U.S. Pat. No. 1,410,066; U.S. Pat. No. 1,495,322; U.S. Pat. No. 1,016,055; and U.S. Pat. No. Des. 277,967.

While these devices fulfill their respective, particular objectives and requirements, the aforementioned patents do not disclose a new reed maintainer for woodwind instruments. The inventive device includes a tubular member having a first end and a second end and having a bore extending therethrough; and also includes slat members being attached to the tubular member and extending outwardly therefrom; and further includes an annular flange member being securely attached to the tubular member.

In these respects, the reed maintainer for woodwind instruments according to the present invention substantially departs from the conventional concepts and designs of the prior art, and in so doing provides an apparatus primarily developed for the purpose of extending the life span of the reed in woodwind instruments.

SUMMARY OF THE INVENTION

In view of the foregoing disadvantages inherent in the known types of reed maintaining device now present in the prior art, the present invention provides a new reed maintainer for woodwind instruments construction wherein the same can be utilized for extending the life span of the reed in woodwind instruments.

The general purpose of the present invention, which will be described subsequently in greater detail, is to provide a new reed maintainer for woodwind instruments which has many of the advantages of the reed maintaining device mentioned heretofore and many novel features that result in a new reed maintainer for woodwind instruments which is not anticipated, rendered obvious, suggested, or even implied by any of the prior art reed maintaining device, either alone or in any combination thereof.

To attain this, the present invention generally comprises a tubular member having a first end and a second end and having a bore extending therethrough; and also includes slat members being attached to the tubular member and extending outwardly therefrom; and further includes an annular flange member being securely attached to the tubular member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new reed maintainer for woodwind instruments which has many of the advantages of the reed maintaining device mentioned heretofore and many novel features that result in a new reed maintainer for woodwind instruments which is not anticipated, rendered obvious, suggested, or even implied by any of the prior art reed maintaining device, either alone or in any combination thereof.

It is another object of the present invention to provide a new reed maintainer for woodwind instruments which may be easily and efficiently manufactured and marketed.

It is a further object of the present invention to provide a new reed maintainer for woodwind instruments which is of a durable and reliable construction.

An even further object of the present invention is to provide a new reed maintainer for woodwind instruments which is susceptible of a low cost of manufacture with regard to both materials and labor, and which accordingly is then susceptible of low prices of sale to the consuming public, thereby making such reed maintainer for woodwind instruments economically available to the buying public.

Still yet another object of the present invention is to provide a new reed maintainer for woodwind instruments which provides in the apparatuses and methods of the prior art some of the advantages thereof, while simultaneously overcoming some of the disadvantages normally associated therewith.

Still another object of the present invention is to provide a new reed maintainer for woodwind instruments for extending the life span of the reed in woodwind instruments.

Yet another object of the present invention is to provide a new reed maintainer for woodwind instruments which includes Still yet another object of the present invention is to provide a new reed maintainer for woodwind instruments that maintains the shape of the reeds while remaining in the woodwind instruments.

Even still another object of the present invention is to provide a new reed maintainer for woodwind instruments that eliminates the user from having to remove the reeds from the woodwind instruments.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a top perspective view of the present invention.

FIG. 4 is a bottom plan view of the present invention.

DESCRIPTION OF THE PREFERRED EMBODIMENT

Figure 1:
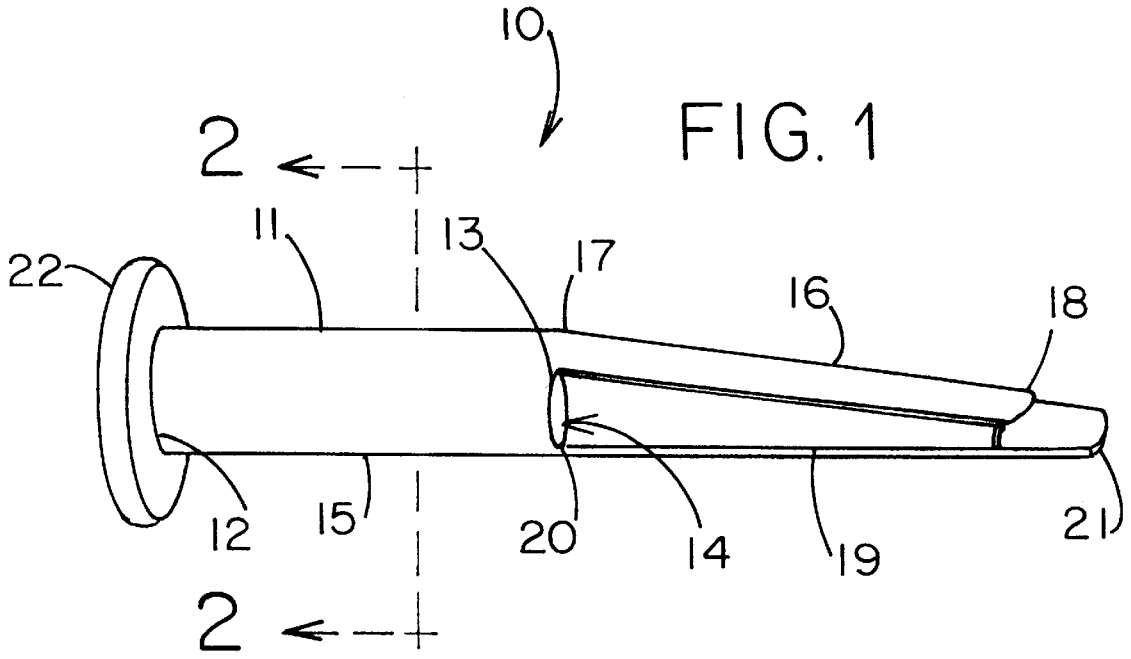
FIG. 1 is a side perspective view of a new reed maintainer for woodwind instruments according to the present invention.
Figure 2:
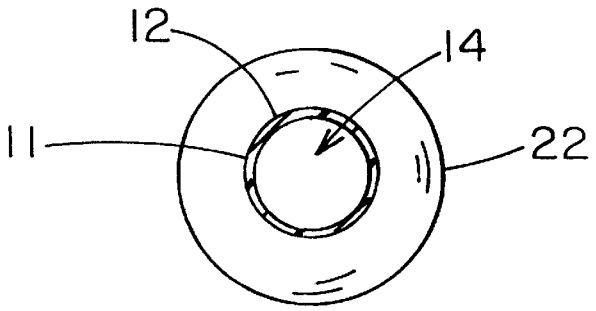
FIG. 2 is an end elevational view of the present invention.

With reference now to the drawings, and in particular to FIGS. 1 through 4 thereof, a new reed maintainer for woodwind instruments embodying the principles and concepts of the present invention and generally designated by the reference numeral 10 will be described.

As best illustrated in FIGS. 1 through 4, the reed maintainer for woodwind instruments 10 generally comprises a tubular member 11 having a first end 12 and a second end 13 and having a bore 14 extending therethrough. Slat members 16,19 are securely and conventionally attached to the tubular member 11 and extend outwardly therefrom. The slat members 16,19 include a first slat member 16 having a second end 18 and a first end 17 which is securely and conventionally attached to the second end 13 of the tubular member 11, and also include a second slat member 19 having a second end 21 and a first end 20 which is also securely and conventionally attached to the second end 13 of the tubular member 11 with the first ends 17,20 of the first and second slat members 16,19 being diametrically attached to a side wall 15 of the tubular member 11. The first slat member 16 is angled relative to the second slat member 19 with the second end 18 of the first slat member 16 being in contactable relationship with the second slat member 19 near the second end 21 thereof. The first slat member 16 has a length that is shorter than a length of the second slat member 19.

An annular flange member 22 is securely and conventionally attached to the tubular member 11 with the annular flange member 22 being attached at the first end 12 of the tubular member 11.

In use, the reed maintainer 10 is inserted into the reed or mouthpiece while the reed or mouthpiece remains in the woodwind instrument in order for the reed to maintain its shape and form after being used and after the reed dries.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A reed maintainer for woodwind instruments comprising:

a tubular member having a first end and a second end and having a bore extending therethrough;

slat members being attached to said tubular member and extending outwardly therefrom;

an annular flange member being attached to said tubular member;

wherein said slat members include a first slat member having a first end and a second end, said first end of said first slat member being attached to said second end of said tubular member, a second slat member having a first end and a second end, said first end of said second slat member being attached to said second end of said tubular member; and wherein said first ends of said first and second slat members are attached to opposite locations on a side wall of said tubular member.

2. A reed maintainer for woodwind instruments comprising:

a tubular member having a first end and a second end and having a bore extending therethrough;

slat members being attached to said tubular member and extending outwardly therefrom;

an annular flange member being securely attached to said tubular member;

wherein said slat members include a first slat member having a second end and a first end which is securely attached to said second end of said tubular member, and also include a second slat member having a second end and a first end which is also securely attached to said second end of said tubular member; and wherein said first ends of said first and second slat members are diametrically attached to a side wall of said tubular member.

3. A reed maintainer for woodwind instruments as described in claim 2, wherein said first slat member is angled relative to said second slat member.

4. A reed maintainer for woodwind instruments as described in claim 3, wherein said second end of said first slat member is in contactable relationship with said second slat member near said second end thereof, said first slat member having a length that is shorter than a length of said second slat member.

5. A reed maintainer for woodwind instruments as described in claim 2, wherein said annular flange member is attached at said first end of said tubular member.

6. A reed maintainer for woodwind instruments comprising:

a tubular member having a first end and a second end and having a bore extending therethrough;

slat members being attached to said tubular member and extending outwardly therefrom, said slat members including a first slat member having a second end and a first end which is securely attached to said second end of said tubular member, and also including a second slat member having a second end and a first end which is also securely attached to said second end of said tubular member, said first ends of said first and second slat members being diametrically attached to a side wall of said tubular member, said first slat member being angled relative to said second slat member, said second end of said first slat member being in contactable relationship with said second slat member near said second end thereof, said first slat member having a length that is shorter than a length of said second slat member; and an annular flange member being securely attached to said tubular member, said annular flange member being attached at said first end of said tubular member.

7. A reed maintainer for woodwind instruments as described in claim 1, wherein said first slat member is angled relative to said second slat member.

8. A reed maintainer for woodwind instruments as described in claim 1, wherein said second end of said first slat member is in contactable relationship with said second slat member near said second end thereof, said first slat member having a length that is shorter than a length of said second slat member.

9. A reed maintainer for woodwind instruments as described in claim 1, wherein said annular flange member is attached at said first end of said tubular member.

* * * * *